US005987812A

United States Patent [19]

Knell

[11] Patent Number: 5,987,812

[45] Date of Patent: Nov. 23, 1999

[54] PLANT STAND SYSTEM

[75] Inventor: Roger D. Knell, Yorkville, Ill.

[73] Assignee: Stem Systems, Inc., Yorkville, Ill.

[21] Appl. No.: 08/939,581

[22] Filed: Sep. 29, 1997

[51] Int. Cl.[6] ..... A47G 7/00; A01G 9/00

[52] U.S. Cl. ..... 47/39; 47/18

[58] Field of Search ..... 47/18, 33, 44, 47/39; 248/154, 185.1, 140, 598.3; 211/207, 74, 181.1; 239/44; D11/144–148

[56] References Cited

U.S. PATENT DOCUMENTS

| | | | |
|---|---|---|---|
| D. 224,746 | 9/1972 | Kyle | D11/2 |
| D. 225,252 | 11/1972 | Ware | D11/144 |
| D. 307,877 | 5/1990 | White, Jr. | D11/148 |
| D. 324,658 | 3/1992 | Crowley | D11/145 |
| 1,885,117 | 11/1932 | Lemert | 47/39 |
| 2,051,241 | 8/1936 | Biggers | 47/40 |
| 3,015,024 | 12/1961 | Charchan et al. | 47/39 |
| 3,664,063 | 5/1972 | Ware | 47/39 |
| 3,772,827 | 11/1973 | Ware | 47/39 |
| 3,842,534 | 10/1974 | Walters et al. | 47/1.1 |
| 3,978,612 | 9/1976 | Young | 47/40 |
| 4,045,911 | 9/1977 | Ware | 47/39 |
| 4,170,844 | 10/1979 | Steele | 47/62 |
| 4,184,415 | 1/1980 | Nicholson | 211/86 |
| 4,236,353 | 12/1980 | Sorenson | 47/81 |
| 4,244,145 | 1/1981 | Polacsek | 47/17 |
| 4,276,720 | 7/1981 | Lyon | 47/39 |
| 4,513,531 | 4/1985 | Lestraden | 47/39 |
| 5,454,187 | 10/1995 | Wasserman | 47/39 |
| 5,584,141 | 12/1996 | Johnson | 47/39 X |

FOREIGN PATENT DOCUMENTS

| | | | |
|---|---|---|---|
| 2390897 | 1/1979 | France | 47/39 |
| 3906121 | 8/1990 | Germany | 47/39 |
| 8401089 | 11/1985 | Netherlands | 47/39 S |
| 968489 | 9/1964 | United Kingdom | 47/39 |

OTHER PUBLICATIONS

Horticulture, vol. LIV, No. 10, p. 75, two advertisments on top and bottom of p. 75, Oct. 1976.

*Primary Examiner*—Michael J. Carone
*Assistant Examiner*—Fredrick T. French, III
*Attorney, Agent, or Firm*—Kenneth A. Rhoads

[57] ABSTRACT

A plant stand system 10 for growing plants from seedlings and for growing and storing indoor plants includes a frame assembly 12 having first and second T-shaped support assemblies 14, 16, first and second generally L-shaped light arms 64, 66, and at least one pair of tray brackets 84 secured to the T-shaped support assemblies 14, 16. The plant stand system 10 further includes at least one plant tray 94, and a plurality of flexible chain members 96, and at least one light fixture 104 connected to the flexible members 96. The light fixture 104 and tray 94 is easily adjustable and access to the plant tray 94 is convenient from all sides of the plant stand 10 system.

22 Claims, 7 Drawing Sheets

100
70
64
12
100
98
98
96
104
10
66
100
70
68
38
100
98
98
18
36
104
38
28
68
106
84
78
24
28
78
20
18
84
36
96
104
84
28
26
106
84
44
14
50
16
40
58
48
28
60
46
40
56
50
62
44
34
48
54
46
34

10
3
100
98
74
64
66
106
104
96
78
38
76
22
24
28
16
94
84
36
14
18
12
26
54
56
34

PLANT STAND SYSTEM

TECHNICAL FIELD

The present invention relates to a plant stand system used to provide a desirable environment for growing seedlings to exotic indoor plants.

BACKGROUND ART

Plant stands have historically been used for growing plants. Professionals and hobbyist use multitier plant stands to start seedlings, and to store and grow for example, herbs, orchids, African violets, cactus, and exotic indoor plants. The plant stands have light fixtures with wide spectrum plant light fluorescent tubes that produce radiant energy ideal for growing the plants. The light fixtures are often adjustably positioned over the plant species to provide optimum light intensity. Most prior art plant stands have a multi-support frame structure, which makes it difficult to tend to the plants except from the front or rear of the stands. Such frame structures also make it difficult to remove or add plants except from the very front of the stands. Additionally, many of the prior art plant stands require tools to assemble or adjust the shelves and lights, and further require two or more persons to accomplish the adjustments. Many prior art plant stands are quite expensive and are also difficult to fabricate.

The present invention is directed to overcoming one or more of the problems set forth above.

DISCLOSURE OF THE INVENTION

In one aspect of the invention of a plant stand system, a frame assembly includes first and second T-shaped support assemblies. First and second stringers interconnect the first and second T-shaped support assemblies in spaced apart relationship. First and second generally L-shaped light arms are connected to the T-shaped support assemblies and the first stringer. The L-shaped light arms each have first and seconds ends with the second ends converging toward each other. A pair of cantilevered tray brackets are adjustably secured to the first and second T-shaped support assemblies. A tray is adapted to be supported on the tray brackets. Pluralities of flexible members are connected to the L-shaped light arms with each of the L-shaped light arms having a fastening portion and an outrigger portion. The flexible members are connected to the outrigger portions and the outrigger portions are positioned above the tray brackets. A light fixture is adjustably connected to the flexible members directly above the tray.

In another aspect of the invention of a plant stand system, a frame assembly includes first and second T-shaped support assemblies. First and second stringers interconnect the first and second T-shaped support assemblies in spaced apart relationship. First and second generally L-shaped light arms are connected to the T-shaped support assemblies and the first stringer. The L-shaped light arms each have first and seconds ends with the second ends converging toward each other. Pluralities of cantilevered tray brackets are adjustably secured to the first and second T-shaped support assemblies. A plurality of trays are adapted to be supported on the tray brackets with each tray being positioned directly above or directly below another tray. Pluralities of flexible members are connected to the L-shaped light arms with each of the L-shaped light arms having a fastening portion and an outrigger portion. The flexible members are connected to the outrigger portions and the outrigger portions are positioned above the tray brackets. A light fixture is adjustably connected to the flexible members directly above each of the trays.

In yet another aspect of the invention of a plant stand system, a frame assembly including first and second T-shaped support assemblies. Each support assembly has first and second sides. First and second stringers interconnect the first and second T-shaped frame assemblies in spaced apart relationship. First, second, third and fourth generally L-shaped light arms are connected to the T-shaped support assemblies and the first stringer. The first and second generally L-shaped light arms extending outwardly from the T-shaped support in a first direction and the third and fourth generally L-shaped light arms extending outwardly from the T-shaped support assembly in a second direction. The L-shaped light arms each have first and second ends, with the second ends of the first and second light arms converging toward each other and the second ends of the third and fourth light arms converging toward each other. A pair of cantilevered tray brackets are adjustably secured to each of the first and second sides of the first and second T-shaped support assemblies. A tray is adapted to be supported on each pair of tray brackets. A pluralities of flexible members are connected to each of said L-shaped light arms with each of the L-shaped light arms having a fastening portion and an outrigger portion. The flexible members are connected to the outrigger portion with the outrigger portions being positioned above the tray brackets. A light fixture is adjustably connected to the flexible members directly above each of the trays.

In still another aspect of the invention of a plant stand system, a frame assembly including first and second T-shaped support assemblies. Each support assembly has first and second sides. First and second stringers interconnect the first and second T-shaped support assemblies in spaced apart relationship. First, second, third and fourth generally L-shaped light arms are connected to the T-shaped support assemblies and the first stringer. The first and second generally L-shaped light arms extending outwardly from the T-shaped support assemblies in a first direction and the third and fourth generally L-shaped light arms extending outwardly from the T-shaped support assemblies in a second direction. The L-shaped light arms each have first and second ends, with the second ends of the first and second light arms converging toward each other and the second ends of the third and fourth light arms converging toward each other. Pluralities of cantilevered tray brackets are adjustably secured to the first and second sides of the first and second T-shaped support assemblies. Pluralities of trays are adapted to be supported on the tray brackets with each tray being positioned directly above or directly below another tray. Pluralities of flexible members are connected to each of said L-shaped light arms with each of the L-shaped light arms having a fastening portion and an outrigger portion. The flexible members are connected to the outrigger portion with the outrigger portions being positioned above the tray brackets. A light fixture is adjustably connected to the flexible members directly above each of the trays.

BEST MODE FOR CARRYING OUT THE INVENTION

Figure 1:
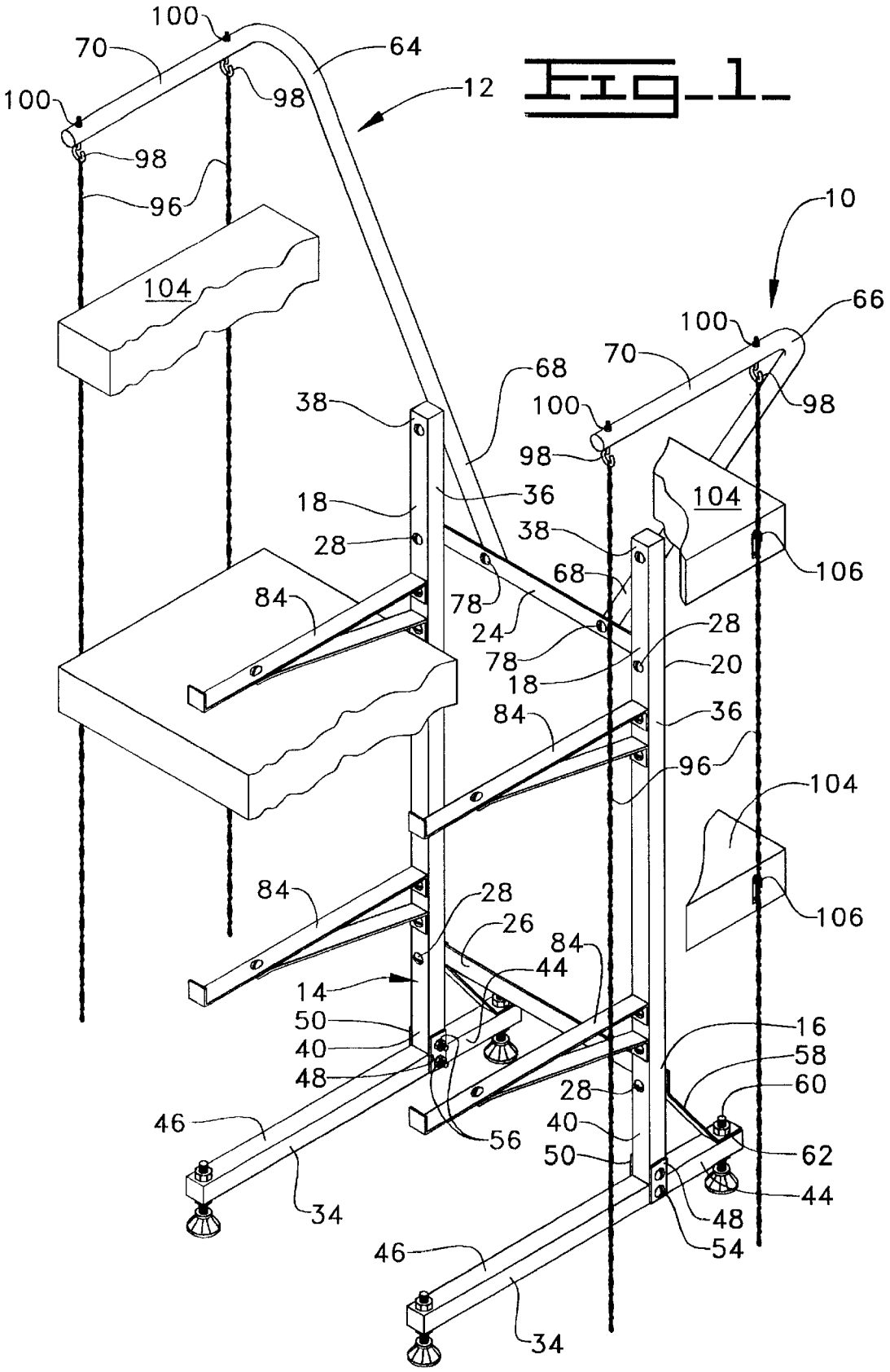
FIG. 1 is a right side perspective view of the plant stand system in accordance with the present invention, with the plant trays removed.
Figure 2:
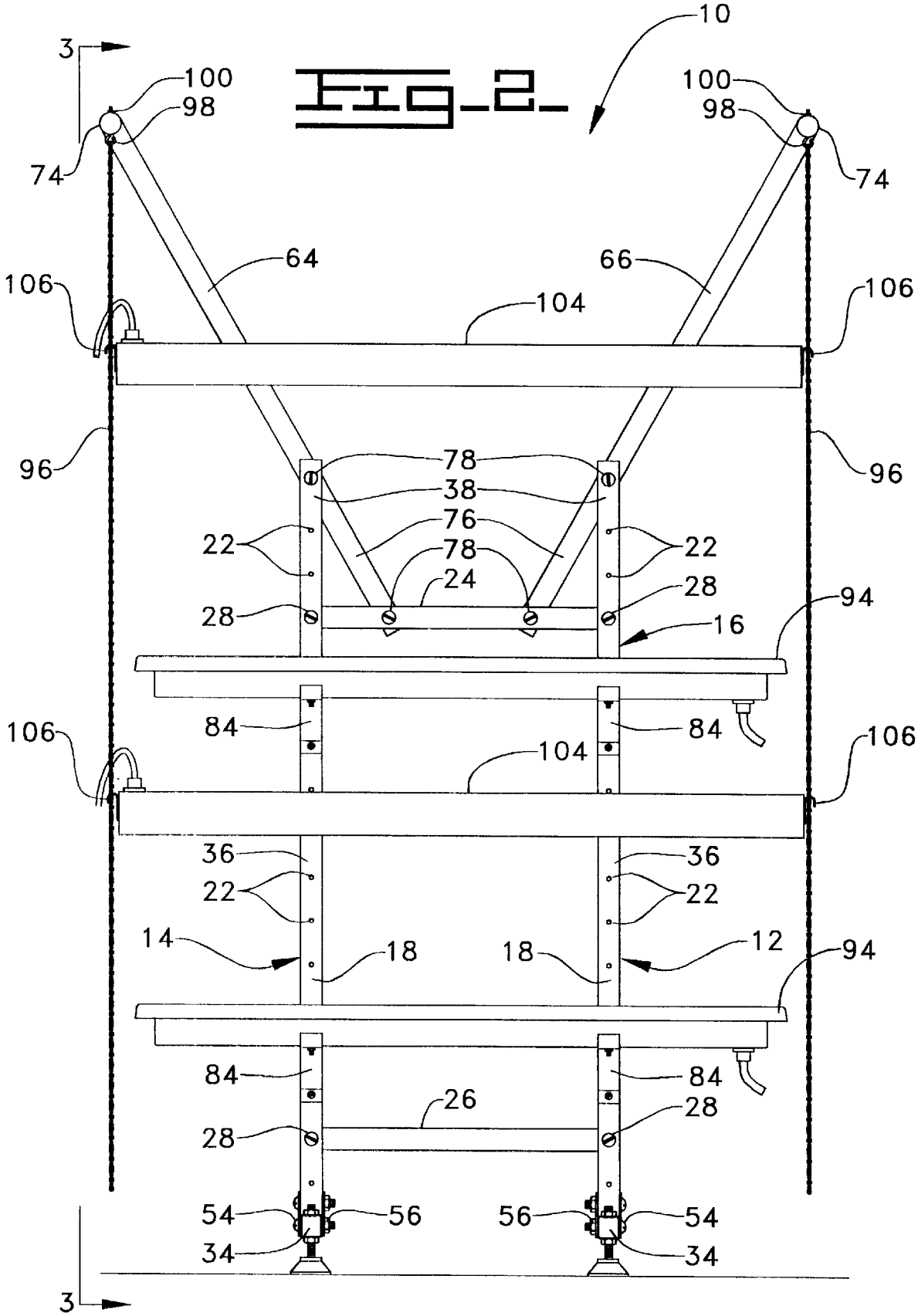
FIG. 2 is a front elevational view of the plant stand system.

Referring to the drawings, a plant stand system 10 of this invention comprises a frame assembly 12 including first and second T-shaped support assemblies 14 and 16. Each T-shaped support assembly 14 and 16 has first and second sides 18 and 20, A plurality of evenly spaced apertures 22 are defined in the first and second sides 18 and 20. First and second cross stringer supports 24 and 26 interconnects the first and second T-shaped support assemblies 14 and 16 in spaced apart relationship. The ends of the stringer supports 24 and 26 are secured to the T-shaped support assemblies 14 and 16 by a stinger carriage bolt 28 and stinger nut 30.

The first and second T-shaped support assemblies 14 and 16 include a generally horizontal tubular base member 34 and a generally vertical tubular post member 36. The generally vertical tubular post members 36 have first and second post ends 38 and 40. The second end 40 of the vertical post member 36 intersects the base member 34 intermediate the ends of the base member 34 and divides the base member 34 into a short portion 44 and a long portion 46. The second end 40 of the post members 36 includes a pair of post plates 48 and 50 that straddle the base member 34. A post carriage bolt 54 and post nut 56 removable secures the post member 36 to the base member 34. Each of the vertical post members 36 and each of the base members 34 are respectively parallel.

In the preferred embodiment, each of the base members 34 and the post members 36 is a square tube. The base members 34 and the post members 36 are formed of metal having a cross-sectional dimension of approximately 50.8 mm. It is recognized that the base and post members 34 and 36 could be manufactured from material other than metal, such as plastic. Each T-shaped support assembly 14 and 16 includes a diagonal support brace 58 connecting the base member 34 and the post member 36. The support braces 58 are secured to the base members 34 and the post members 36 by brace carriage bolts 60 and brace nuts 62.

The frame assembly 12 further includes first and second generally L-shaped light arms 64 and 66. Each of the light arms 64 and 66 have a fastening portion 68, an outrigger portion 70, and first and second arm ends 74 and 76. The second ends 76 of the first and second light arms 64 and 66 converge toward each other. The fastening portion 68 and the second end 76 of each light arm 64 and 66 are connected to the T-shaped support assemblies 14, 16 and to the first stringer 24 respectively by an arm carriage bolt 78 and arm nut 80.

The first and second light arms 64 and 66 are tubular and formed of metal having a cross-sectional diameter of approximately 37 mm. It is recognized that the light arms 64 and 66 could be manufactured from material other than metal, such as plastic.

Figure 3:
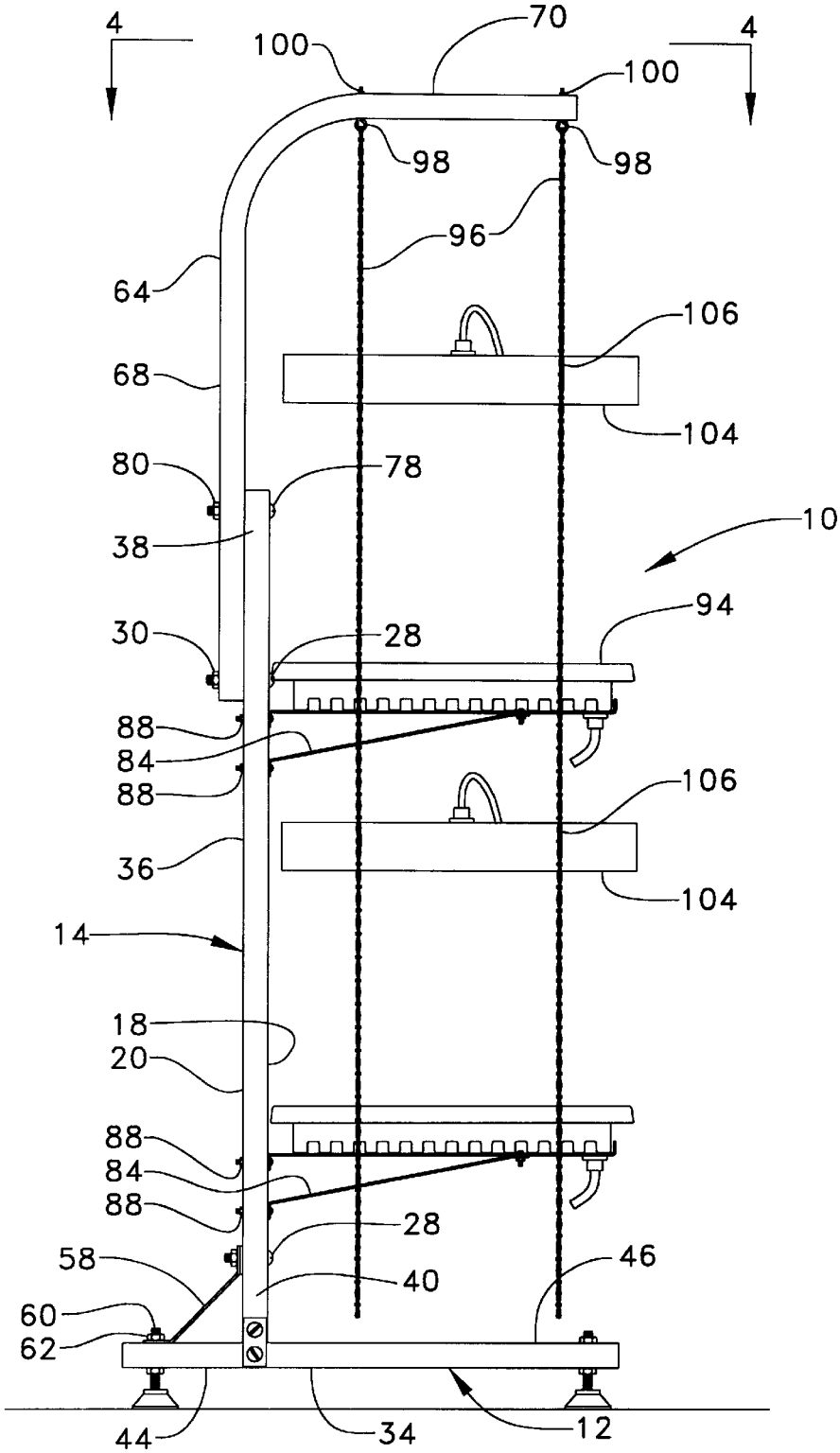
FIG. 3 is a left side elevational view of the plant stand system taken in the direction of arrows 3—3 of FIG. 2.
Figure 4:
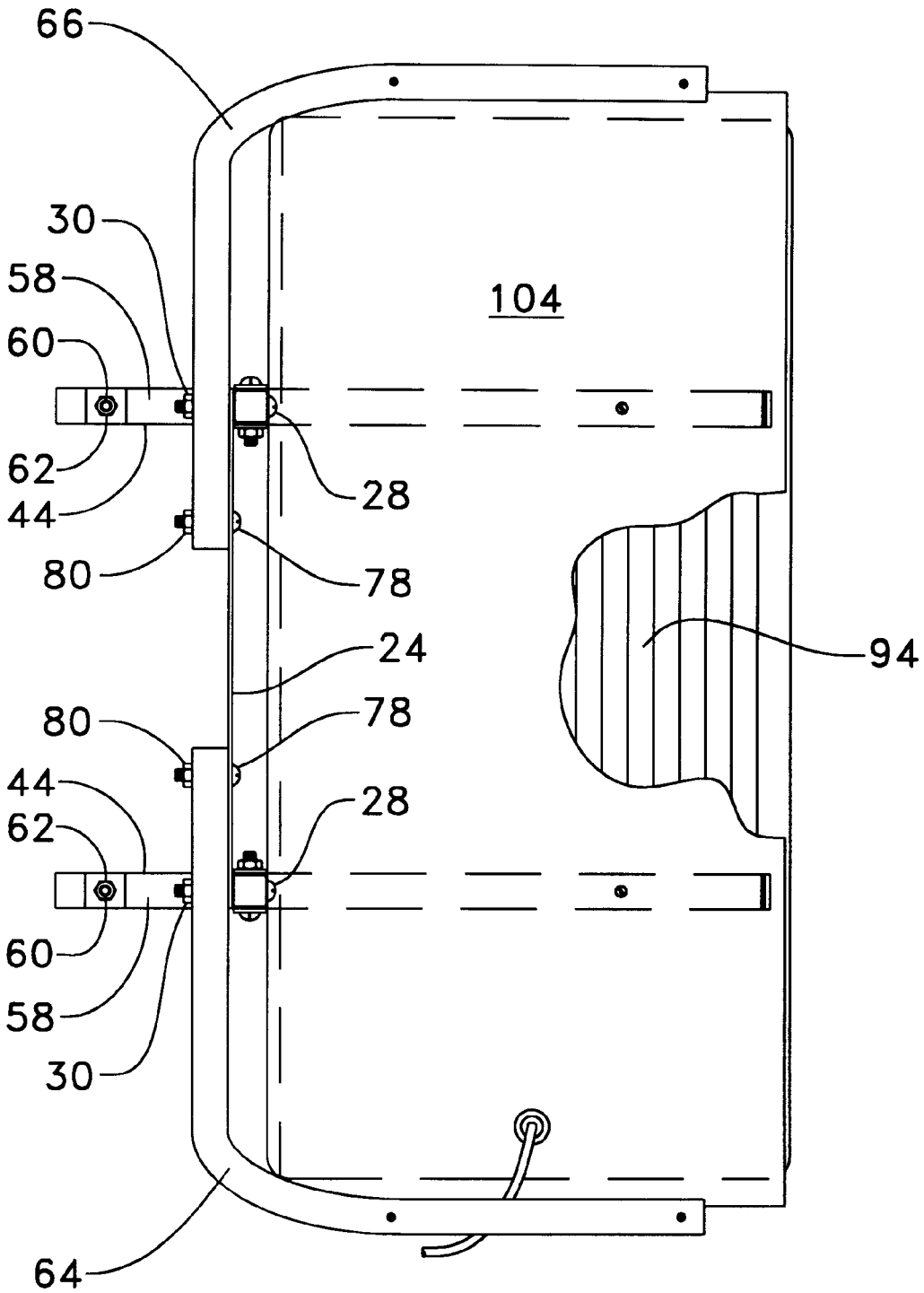
FIG. 4 is a top elevational view of the plant stand system with a portion of the light fixture broken away to show a plant tray, taken in the general direction of arrows 4—4 on FIG. 3.
Figure 5:
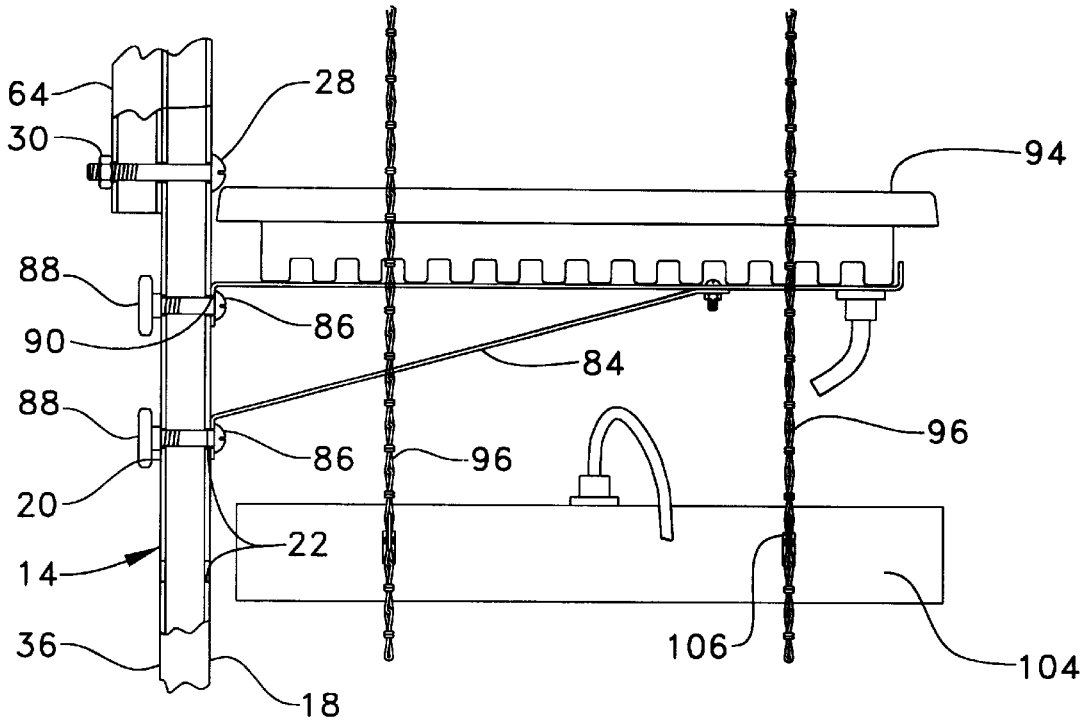
FIG. 5 is an enlarged left side elevational view of a portion the plant stand system as shown in FIG. 3, illustrating a portion of the frame assembly, a plant tray bracket, a plant tray and a light fixture.
Figure 6:
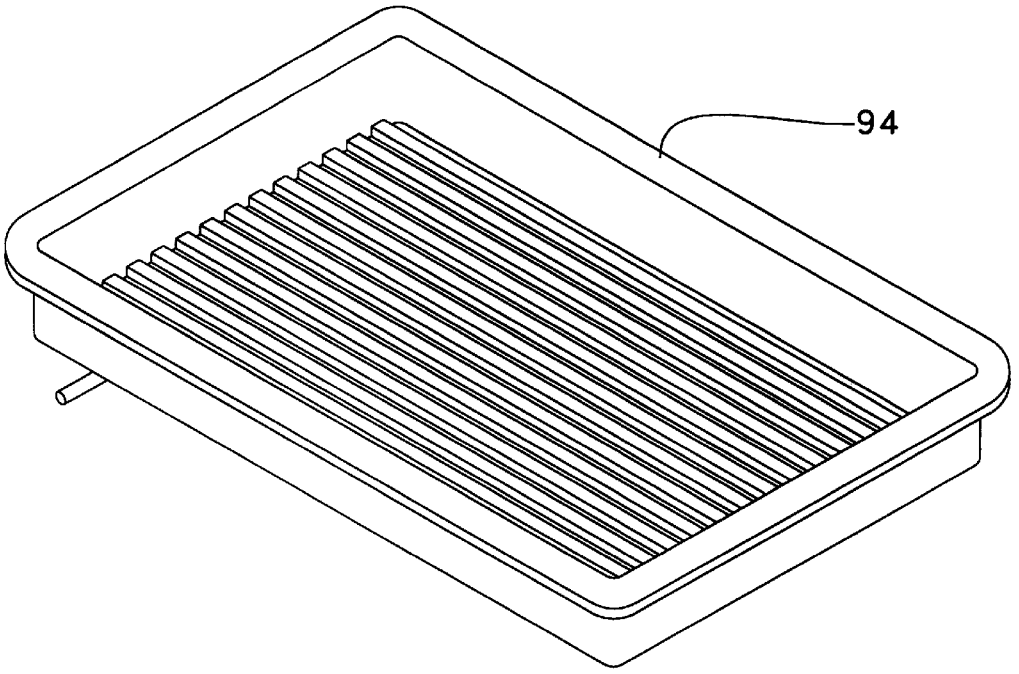
FIG. 6 is a perspective view showing the plant tray.

As best shown in FIGS. 1, 3 and 5 a pair of cantilevered tray brackets 84 are adjustably secured to the first side 18 of the first and second T-shaped support assemblies 14 and 16. The brackets 84 are adjustably secured to the T-shaped support assemblies 14 and 16 by a plurality of bracket carriage bolts 86 and threaded star nuts 88. The carriage bolts 86 pass through bracket apertures 90 defined in the tray bracket 84 and through the apertures 22 in the support assemblies 14 and 16.

As shown in FIGS. 1, 2, 3, 4 and 5 a plurality of trays 94 are adapted to be supported on the tray brackets 84. In the preferred embodiment the trays are manufactured from polyethylene. It is recognized that a plurality of cantilevered tray brackets 84 may be adjustably secured to the first side 18 of the first and second T-shaped support assemblies 14, 16 with each tray 94 being positioned directly above or directly below another tray 94. The trays 94 are portioned above the long portion 46 of the base member 34.

A plurality of flexible members 96 are connected to the outrigger portion 70 of the L-shaped light arms 64 and 66 by eyebolts 98 and nuts 100. The flexible members 96 can include polycoated linked chain members. The outrigger portions 70 are positioned substantially above the tray brackets 84.

A light fixture 104 is adjustably connected to the flexible members 96 directly above each of the trays 94. The light fixtures 104 may be of conventional construction having 2 or more fluorescent tubes of the type to promote plant growth. The light fixtures 104 are connected to the flexible members 96 by a plurality of S-hooks 106.

The tray brackets 84, the light fixtures 104 and the outrigger portion 70 of the light arms 64 and 66 extend outwardly of the post members 36 in a common direction.

The plant stand system 10 includes at least one pair of tray brackets 84, at least one tray 94 and at least one light fixture 104. It is recognized that the plant stand system 10 may include at least two pair of tray brackets 84, at least two trays 94 and at least two light fixtures 104.

Figure 7:
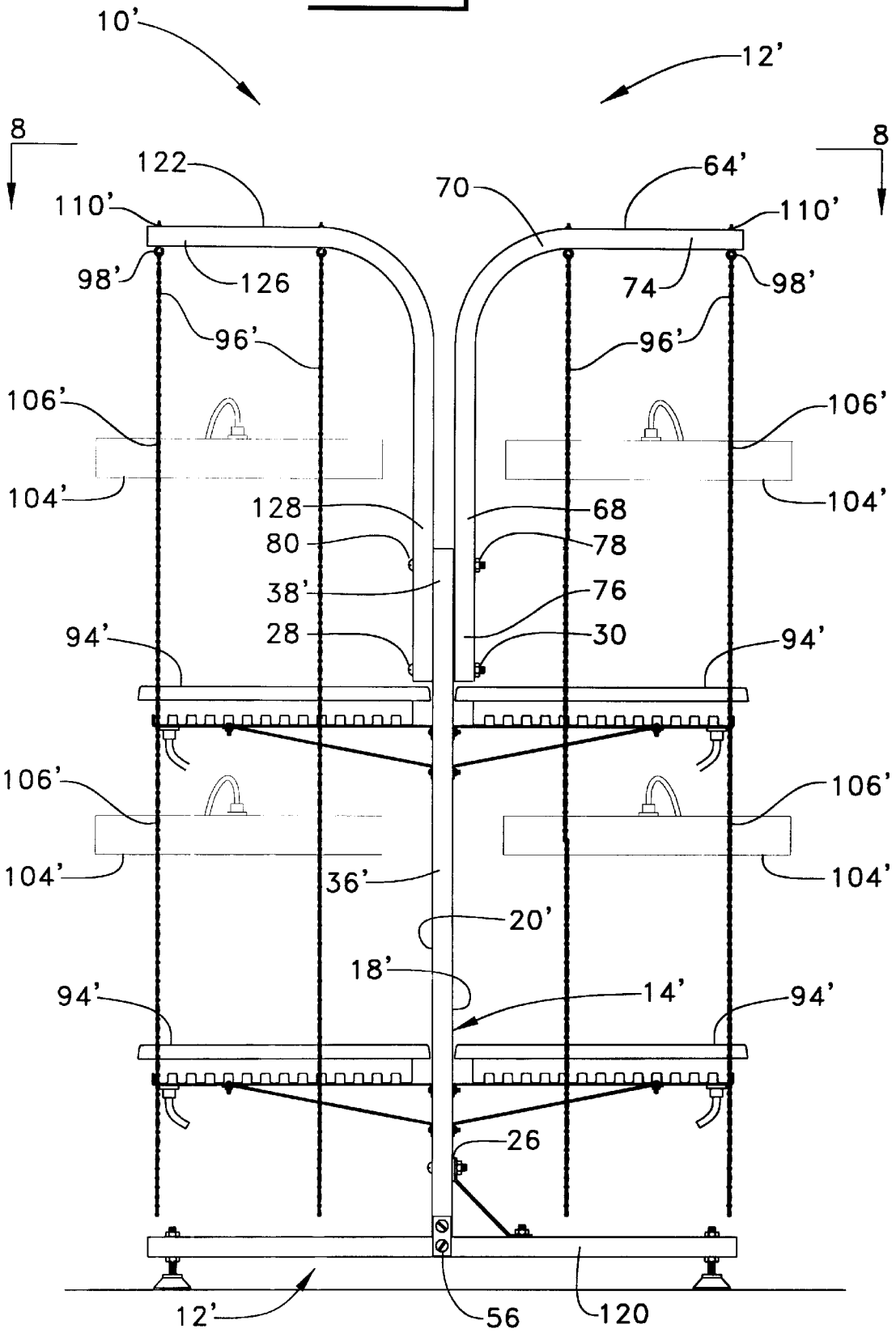
FIG. 7 is a side elevational view of an alternate embodiment of the plant stand system showing plant tray brackets, plant trays and light fixtures on both sides of the frame assembly.
Figure 8:
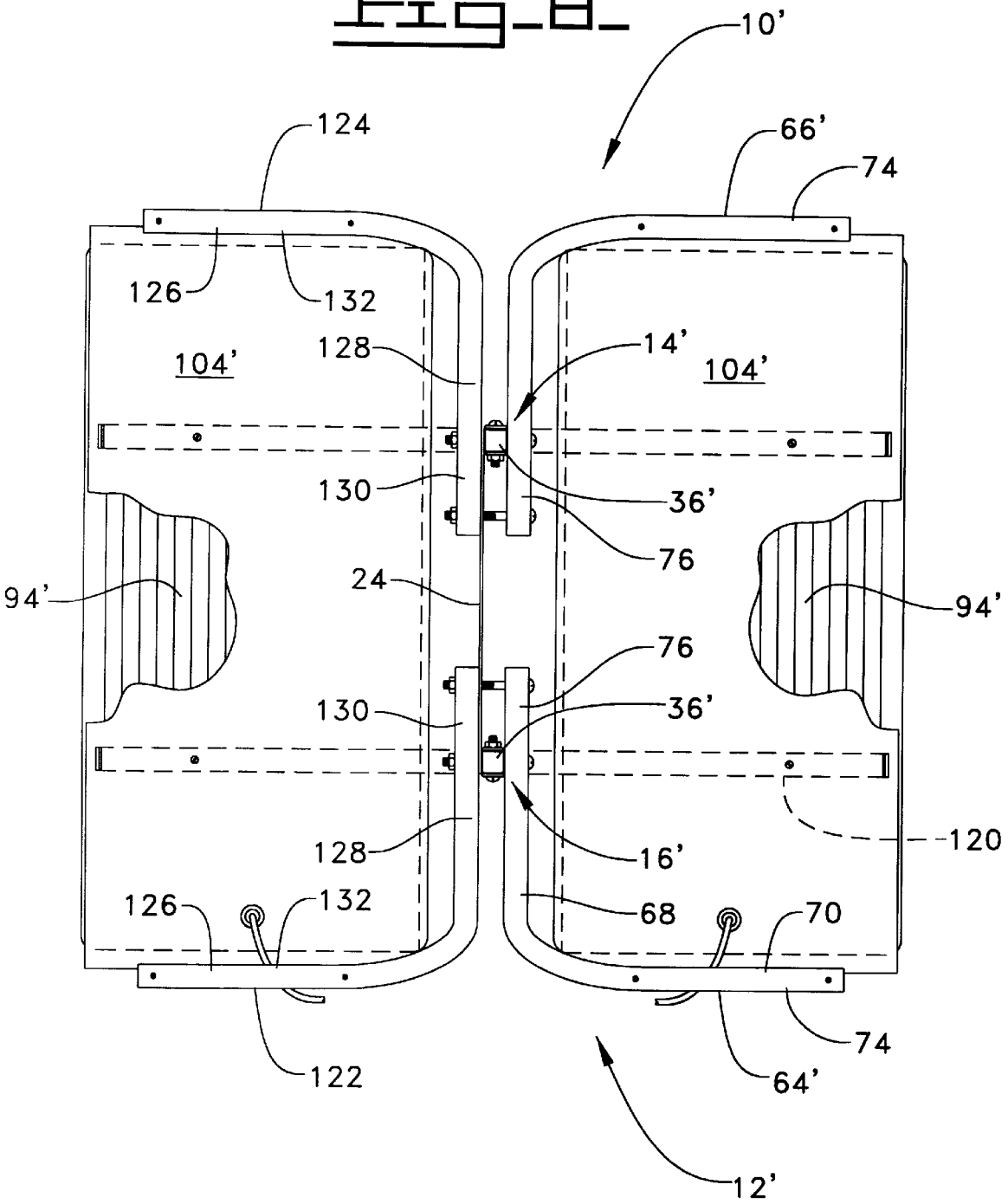
FIG. 8 is a top elevational view of the alternate embodiment of plant stand system taken in the direction of arrows 8—8 of FIG. 7.

With particular reference to FIGS. 7 and 8, which illustrate an alternate embodiment of the present invention, a plant stand system 10', comprising a frame assembly 12' includes first and second T-shaped tubular support assemblies 14', 16'. Each support assembly 14', 16' has first and second sides 18', 20', and first and second stringers 24', 26' interconnect the first and second T-shaped support assemblies 14', 16' in spaced apart relationship. The T-shaped tubular support assemblies 14', 16' further include a generally vertical post member 36' and a base member 120 with the post member 36' intersecting the base member 120 intermediate the ends of the base member 120. This essentially divides the base member 120 into substantially equal portions.

First and second generally L-shaped light arms 64', 66' and third and fourth generally L-shaped tubular light arms 122, 124 are connected the T-shaped support assemblies 14', 16' and to the first stringer 24'.

The first and second L-shaped light arms 64', 66' extending outwardly from said T-shaped support assemblies 14', 16' in a first direction. The third and fourth generally L-shaped light arms 122, 124 extend outwardly from the T-shaped support assemblies 14', 16' in a second generally opposite direction.

The L-shaped light arms 64', 66' each have first and second ends 74', 76' with the second ends 76' of the first and second light arms 64', 66' converging toward each other. The third and fourth L-shaped light arms 122, 124 each have first and second ends 126, 128 with the second ends 126, 128 of the third and fourth light arms 122, 124 converging toward each other. Each of said L-shaped light arms 64', 66' has a fastening portion 68' and an outrigger portion 70' and each of the L-shaped light arms 122, 124 has a fastening portion 130 and an outrigger portion 132.

A pair of cantilevered tray brackets 84' are adjustably secured to each of the first and second sides 18', 20' of the first and second T-shaped support assemblies 14', 16'. A tray 94' is adapted to be supported on each pair tray brackets 84', with each tray 94'. It is recognized that a plurality of cantilevered trays 84' may be adjustably secured to the first and second sides 18', 20' sides of the first and second T-shaped support assemblies 14', 16' with each tray 94' being positioned directly above or directly below another tray 94'.

A plurality of flexible members 96' are connected to each of the L-shaped light arms 64', 66', 120, 124 by an eyebolt 98' and eyebolt nut 110'. The flexible members 96' are connected to the outrigger portions 70' 132 and the outrigger portions 70', 132 are positioned above the tray brackets 84'. A light fixture 104' is adjustably connected to the flexible members 96' directly above each of the trays 94'. The tray brackets 84' and the light fixtures 104' extend outwardly of the first and second sides 18', 20' of the T-shaped support assemblies 14', 16'. Preferably, the plant stand system 10' includes at least two pairs of tray brackets 84', at least two trays 94' and at least two light fixtures 104' on each side of the support assemblies 14', 16'.

With reference to the drawings and the previous description, the subject plant stand system 10, 10' is particularly useful for growing and storing indoor plants. The T-shaped support assemblies 14, 14', 16, 16' support the tray brackets 84, 84', which in turn support the plant trays 94, 94'. The tray brackets 84, 84' can be,changed independent of the support assemblies 14, 14', 16, 16'. The light arms 64', 66' and 122, 124 are attached to the T-shaped support assemblies 14, 14', 16, 16' and the flexible members 96, 96' are attached to the outrigger portions 70, 70' of the L-shaped light arms 64, 66, 120, 124. The S-type hooks 106, 106' connect into the flexible members 96, 96' and the light fixtures 104, 104' to support the light fixtures 104, 104' from the flexible members 96, 96'. The light arms 64', 66' and 122, 124 are dedicated support structures for the light fixtures 104, 104'. The flexible members 96, 96' have no other function except to support the light fixtures 104, 104'.

The tray bracket 84, 84' and light fixtures 104, 104' are independent of the frame assembly 12 and can be added and removed as desired. To adjust the position of the tray brackets 84, 84' and plant trays 94, 94' relative to the T-shaped support assemblies 14, 14, 16, 16' the plant trays 94, 94' that rests on the tray brackets 84, 84' are removed and the threaded star knobs 88 are loosened by hand and removed. The bracket carriage bolts 86 are removed from the apertures 90, 22 in the tray brackets 84, 84' and the T-shaped support assemblies 14, 14', 16, 16'. The tray brackets 84, 84' are then re-positioned along the T-shaped support assemblies 14, 14', 16, 16' aligning the respective apertures 90 in the tray brackets 84, 84' with a new set of apertures 22 in the T-shaped support assemblies 14, 14', 16, 16'. The carriage bolts 86 are inserted in the apertures 90, 22 and the star knobs 88 threaded on the carriage bolts 86 and tightened to hold the tray brackets 84, 84' securely in place.

To adjust the light fixtures 104, 104' the S-type hooks 106, 106' are removed from the flexible members 96, 96' and the light fixtures 104, 104' are repositioned to a new position relative to the plant trays 94, 94. The S-type hooks 106, 106' are then reinserted into the flexible members 96, 96' to hold the light fixture 104, 104' in the new position. Each adjustment of the tray brackets 84, 84' and the light fixtures 104, 104' takes just a few minutes and can be performed by a single person.

In one embodiment at least one pair of tray brackets 84, a light fixture 104, and the pair of L-shaped light arms 64, 66 extend outwardly of the post members 36 in a common direction. In another embodiment at least one pair of tray brackets 84', one light fixture 104' and one pair of L-shaped light arms 64', 66' extend outwardly of the first and second sides 18', 20' of the T-shaped support assemblies 14', 16'.

Other aspects, objects and advantages of the invention can be obtained from a study of the drawings, the disclosure, and the appended claims.

I claim:

1. A plant stand system, comprising a frame assembly including first and second T-shaped support assemblies, first and second stringers interconnecting said first and second T-shaped support assemblies in spaced apart relationship, first and second generally L-shaped tubular light arms connected to said T-shaped support assemblies and said first stringer, said L-shaped light arms each having first and seconds ends, said second ends of said first and second light arms converging toward each other;

a cantilevered tray bracket adjustably secured to said first and second T-shaped support assemblies;

a tray adapted to be supported on said tray brackets;

a plurality of flexible members connected to said L-shaped light arms, each of said L-shaped light arms having a fastening portion and an outrigger portion, said flexible members being connected to said outrigger portion and said outrigger portions being positioned above said tray brackets; and a light fixture adjustably connected to said flexible members directly above said tray.

2. A plant stand system, as set forth in claim 1, wherein each first and second T-shaped support assemblies includes a generally horizontal base member and a generally vertical post member, said vertical post member intersecting said base member intermediate the ends of said base member.

3. A plant stand system, as set forth in claim 2, wherein each of said vertical post members and each of said base members are respectively parallel.

4. A plant stand system, as set forth in claim 2, wherein each of said support assembly includes a diagonal brace interconnecting said base member and said post member.

5. A plant stand system, as set forth in claim 2, wherein each of said base members is square tube.

6. A plant stand system, as set forth in claim 1, wherein each of said post members is a square tube.

7. A plant stand system, as set forth in claim 1, wherein said flexible members include linked chain members.

8. A plant stand system, as set forth in claim 1, including a plurality of S-hooks connecting said light fixtures to said flexible members.

9. A plant stand system, as set forth in claim 2, wherein said tray brackets, the light fixture and said outriggers of said light arms extend outwardly of said post members in a common direction.

10. A plant stand system, as set forth in claim 1, including at least two pair of tray brackets, at least two trays and at least two light fixtures.

11. A plant stand system, as set forth in claim 1, wherein each first and second T-shaped support assemblies includes a generally horizontal base member and a generally vertical post member, said vertical post member intersecting said base member intermediate the ends of said base member and dividing said base member into a short portion and a long portion with said trays being positioned above said long portion.

12. A plant stand system, comprising a frame assembly including first and second T-shaped support assemblies, first and second stringers interconnecting said first and second T-shaped support assemblies in spaced apart relationship, first and second generally L-shaped tubular light arms connected to said T-shaped support assemblies and said first stringer, said L-shaped light arms each having first and seconds ends, said second ends of said first and second light arms converging toward each other;

a plurality of cantilevered tray brackets adjustably secured to said first and second T-shaped support assemblies;

a plurality of trays adapted to be supported on said tray brackets, each tray being positioned directly above or directly below another tray;

a plurality of flexible members connected to said L-shaped light arms, each of said L-shaped light arms having a fastening portion and an outrigger portion, said flexible members being connected to said outrigger portion and said outrigger portions being positioned above said tray brackets; and a light fixture adjustably connected to said flexible members directly above each of said trays.

13. A plant stand system, as set forth in claim 12, wherein each first and second T-shaped tubular support assemblies includes a generally horizontal base member and a generally vertical post member, said vertical post member intersecting said base member intermediate the ends of said base member.

14. A plant stand system, as set forth in claim 12, wherein said tray brackets, the light fixture and said outriggers of said light arms extend outwardly of said post members in a common direction.

15. A plant stand system, comprising a frame assembly, each frame assembly including first and second T-shaped support assembly having first and second sides, and first and second stringers interconnect the first and second T-shaped support assemblies in spaced apart relationship, first, second third and fourth generally L-shaped tubular light arms connected to said T-shaped support assemblies and said first stringer, said first and second L-shaped light arms extending outwardly from said T-shaped support assembly in a first direction and said third and fourth generally L-shaped light arms extending outwardly from the T-shaped support assembly in a second direction, said L-shaped light arms each having first and second ends, said second ends of said first and second light arms converging toward each other, and said second ends of said third and fourth light arms converging toward each other;

a pair of cantilevered tray brackets adjustably secured to the first and second sides of said first and second T-shaped support assemblies;

a tray adapted to be supported on each pair tray brackets;

a plurality of flexible members connected to each of the L-shaped light arms, each of said L-shaped light arms having a fastening portion and an outrigger portion, said flexible members being connected to said outrigger portions and said outrigger portions being positioned above the tray brackets; and a light fixture adjustably connected to said flexible members directly above each of said trays.

16. A plant stand system, as set forth in claim 15, wherein each first and second T-shaped tubular support assemblies includes a generally horizontal base member and a generally vertical post member, said vertical post member intersecting said base member intermediate the ends of said base member and dividing said base member into substantially equal portions.

17. A plant stand system, as set forth in claim 15, wherein said tray brackets and said light fixtures extend outwardly of said first and second sides of said T-shaped support assemblies.

18. A plant stand system, as set forth in claim 14, including at least two pair of tray brackets, at least two trays and at least two light fixtures.

19. A plant stand system, comprising a frame assembly, each frame assembly including first and second T-shaped support assemblies having first and second sides, and first and second stringers interconnect the first and second T-shaped support assemblies in spaced apart relationship, first, second third and fourth generally L-shaped tubular light arms connected to said T-shaped support assemblies and said first stringer, said first and second L-shaped light arms extending outwardly from said T-shaped support in a first direction and said third and fourth generally L-shaped light arms extending outwardly from the T-shaped support assembly in a second direction, said L-shaped light arms each having first and second ends, said second ends of said first and second light arms converging toward each other, and said second ends of said third and fourth light arms converging toward each other;

a plurality of cantilevered tray brackets adjustably secured to the first and second sides of said first and second T-shaped support assemblies;

a plurality of trays are adapted to be supported on the tray brackets, each tray being positioned directly above or directly below another tray;

a plurality of flexible members connected to each of the L-shaped light arms, each of said L-shaped light arms having a fastening portion and an outrigger portion, said flexible members being connected to said outrigger portions and said outrigger portions being positioned above the tray brackets; and a light fixture adjustably connected to said flexible members directly above each of said trays.

20. A plant stand system, as set forth in claim 19, wherein each first and second T-shaped support assemblies includes a generally horizontal base member and a generally vertical post member, said vertical post member intersecting said base member intermediate the ends of said base member and dividing said base member into substantially equal portions.

21. A plant stand system, as set forth in claim 19, wherein said tray brackets and said light fixtures extend outwardly of said first and second sides of said T-shaped support assemblies.

22. A plant stand system, as set forth in claim 21, including at least two pair of tray brackets, at least two trays and at least two light fixtures.

* * * * *